United States Patent [19]

Gaston

[11] Patent Number: 4,802,861

[45] Date of Patent: Feb. 7, 1989

[54] SELF-ALIGNING ELECTRICAL CONNECTOR

[75] Inventor: Lynn S. Gaston, Fort Worth, Tex.

[73] Assignees: Boeing Vertol Company, Ridley Park, Pa.; Bell Helicopter Textron Inc., Fort Worth, Tex. ; a part interest

[21] Appl. No.: 132,943

[22] PCT Filed: Jun. 15, 1987

[86] PCT No.: PCT/US87/01361

§ 371 Date: Jun. 15, 1987

§ 102(e) Date: Jun. 15, 1987

[87] PCT Pub. No.: WO88/10525

PCT Pub. Date: Dec. 29, 1988

[51] Int. Cl.[4] ..... H01R 13/625; H01R 13/64

[52] U.S. Cl. ..... 439/247; 285/24; 439/376; 439/680

[58] Field of Search ..... 439/246-252, 439/374, 375, 376, 378, 379, 380, 381, 680; 285/24, 27

[56] References Cited

U.S. PATENT DOCUMENTS

| | | | |
|---|---|---|---|
| 2,355,407 | 8/1944 | Wyss | 285/27 |
| 2,572,419 | 10/1981 | Wyss | 285/27 |
| 3,182,280 | 5/1965 | Daut et al. . | |
| 3,755,771 | 8/1973 | Brush | 439/680 |
| 4,095,649 | 6/1978 | Chateau et al. | 285/27 |
| 4,179,179 | 12/1979 | Lowden | 439/364 |
| 4,209,891 | 7/1980 | Lamb et al. | 285/24 |
| 4,620,759 | 11/1986 | Vetter | 439/680 |

FOREIGN PATENT DOCUMENTS 2026061 7/1979 United Kingdom .

*Primary Examiner*—Gil Weidenfeld
*Assistant Examiner*—Gary F. Paumen
*Attorney, Agent, or Firm*—Richards, Harris, Medlock & Andrews

[57] ABSTRACT

A self-aligning electrical connector is provided for aligning and connecting multiple pins of a male coupler with corresponding multiple pin sockets of a female coupler in a blind environment. A cylindrical standpipe is attached to and extends axially from the female connector. The end of the standpipe remote from the female coupler comprises a ramp or cam sloping to a lug slot in the standpipe that extends toward the female coupler. The male coupler includes a lug comprising a cam follower or roller for following the cam of the standpipe. During connection of the couplers, the action of the cam follower on the cam causes axial rotation of the male coupler until the cam follower engages the lug slot to align the couplers. A jackscrew extending through a longitudinal bore along the axis of the male coupler engages a threaded socket located at the axis of the female coupler to draw the pins of the male coupler into mating connection with the pin sockets of the female coupler.

8 Claims, 1 Drawing Sheet

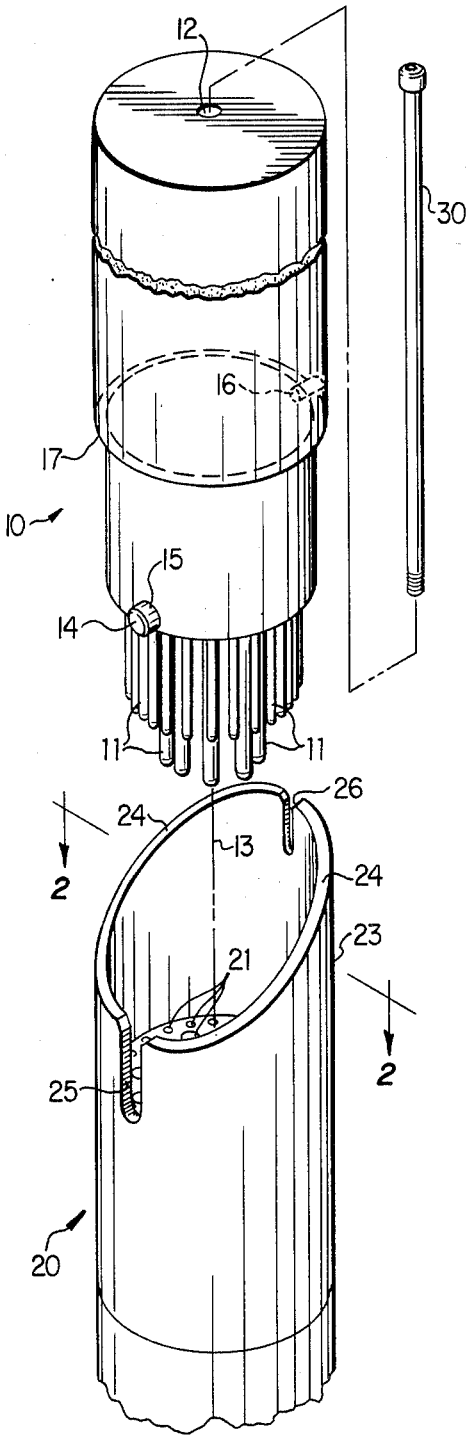
FIG. 1
FIG. 2
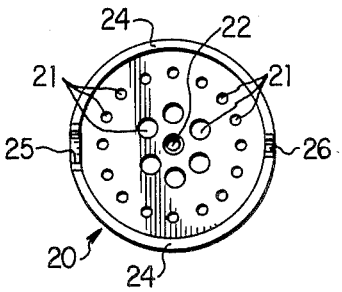

SELF-ALIGNING ELECTRICAL CONNECTOR

TECHNICAL FIELD

The present invention relates to electrical connectors having male and female couplers and, in particular, to a self-aligning multiple pin connector for aligning and connecting the male and female couplers in a blind environment.

BACKGROUND OF THE INVENTION

Machines and electrical devices commonly require the use of electrical connectors comprising a male plug inserted into a female socket. Such electrical connectors allow the device, or components of the device, to be disconnected from electrical power to allow disassembly, maintenance, or repair of the device.

Electrical connectors for complex machinery may include a plurality of electrical pins on a male coupler which mate with a corresponding plurality of pin sockets in a female coupler. The couplers are generally shaped or notched so that they can be connected in only one orientation to allow proper mating of the respective pins and sockets.

In some situations requiring multiple pin electrical connectors, the connector must be positioned in a location inaccessible to human reach. In such situations it is usually possible to provide either or both of the couplers with an extra length of electrical cable. The couplers can be connected by extending the electrical cable when the components of the device are separated, and the cable can be coiled in a suitable place when the components are joined. However, in other blind environments the use of extra cable may be undesirable or impossible.

In a helicopter, for example, an electrical connection is required inside the rotor mast assembly. In the past this type of connection typically involved couplers having an extra length of coiled wire that had to be fed up through a standpipe so that the slipring assembly of the rotor mast could be electrially connected or disconnected from the aircraft. However, highly sophisticated aircraft can require electrical cables having diameters of 1½ inches or more. In such aircraft it may not be possible to provide electrical connectors with extra lengths of cable because it is difficult or impossible to coil such cables sufficiently due to the minimum bend radius of approximately 10 times the diameter of the cable. Furthermore, the substantial weight of an extra length of coiled cable is undesirable in aircraft where weight savings is a major consideration.

Providing a multiple pin electrical connector in a standpipe inaccessible to human reach and sight requires a self-aligning connector for properly orienting and engaging the pins of the connector. Thus, a need has been identified for a self-aligning multiple pin electrical connector that provides proper aligning and mating of the pins of the electrical connector in a blind environment inaccessible to human reach and sight.

SUMMARY OF THE INVENTION

The present invention comprises a self-aligning multiple pin electrical connector for aligning and connecting male and female couplers in a blind environment. The connector comprises a male coupler having a plurality of electrical pins and a female coupler having a corresponding plurality of pin sockets.

The female coupler comprises a plurality of pin sockets extending parallel to the longitudinal axis of the coupler. A threaded socket is provided at the longitudinal axis of the coupler. An open-ended cylindrical standpipe is attached to and extends axially from the female coupler. The rim of the open end of the standpipe forms a cam which slopes toward a lug slot in the standpipe that extends axially toward the female coupler.

The male coupler includes a longitudinal bore along its axis and a plurality of electrical pins extending parallel to the axis. A cam follower, which may comprise a roller, extends radially outward from the male coupler. The electrical connector is joined by inserting the male coupler into the standpipe of the female coupler. The cam follower engages the cam of the standpipe and rotates the male coupler about its axis as the cam follower is guided by the cam into the lug slot. With the cam follower in the lug slot the pins of the male coupler are aligned with the sockets of the female coupler. A jackscrew extending through the bore of the male coupler engages the threaded socket of the female coupler to draw the couplers together and mate the pins with the pin sockets. Thus, the alignment and mating of the pins of the male coupler with the sockets of the female coupler can be accomplished in a blind environment inaccessible to human reach and sight.

BRIEF DESCRIPTION OF THE DRAWINGS

For a more complete understanding of the present invention and for further advantages thereof, reference is made to the following Description of the Preferred Embodiment taken in conjunction with the accompanying Drawings, in which:

FIG. 1 is an isometric drawing of the disconnected male and female couplers of the electrical connector of the present invention; and FIG. 2 is an axial view of the female coupler of the present invention taken in the direction indicated by the section line 2—2 of FIG. 1.

DESCRIPTION OF THE PREFERRED EMBODIMENT

Referring to FIGS. 1 and 2, the self-aligning multiple pin electrical connector of the present invention is illustrated with the couplers disconnected. The electrical connector comprises a male coupler 10 having a plurality of electrical pins 11 and a female coupler 20 having a corresponding plurality of pin sockets 21.

The male coupler 10 has a longitudinal bore 12 along the axis 13 of the male coupler 10. The electrical pins 11 extend from the coupler 10 parallel to the axis 13. A cam follower lug 14 extends radially outward from the coupler 10. A roller 15 may be mounted to rotate about the cam follower lug 14. The male coupler 10 may also include an anti-drive lug 16 extending radially outward from the coupler 10 on the side opposite the cam follower 14. The lug 16 has a diameter less than that of the cam follower 14. The embodiment of the male coupler 10 adapted for a helicopter rotor mast may include a slip ring assembly 17 which is rotatable about the male coupler 10.

The female coupler 20 includes a plurality of pin sockets 21 corresponding to the plurality of pins 11. A threaded socket 22 is positioned at the axis of the female coupler 20. An open-ended cylindrical standpipe 23 is attached to and extends axially from the female coupler 20. The rim of the open end of the standpipe 23 forms a cam 24 which slopes toward a lug slot 25 in the standpipe 23 that extends toward the female coupler 20. The standpipe 23 may include a second lug slot 26 on the opposite side of the standpipe 23 from the lug slot 25. The width of the lug slot 26 is less than the diameter of the cam follower roller 15.

In a helicopter, the female coupler 20 of the present invention is positioned inside the rotor mast assembly. In this location, the pins 11 of the male coupler 10 must be aligned and mated with the pin sockets 21 of the female coupler 20 without being observed. During connection, the male coupler 10 is inserted into the rotor mast assembly with the pins 1 extending toward the female coupler 20. The roller 15 of the cam follower 14 contacts the cam 24 of the standpipe 23 of the female coupler 20. The diameter of the cam follower roller 15 is greater than the width of the slot 26 to prevent improper alignment of the pins 11 with the pin sockets 21 as a result of the cam follower 14 becoming engaged in the slot 26. The cam follower 14 and roller 15 follow the cam 24 which leads toward the cam follower slot 25. The action of the cam follower 14 on the cam 24 causes the male coupler 10 to rotate about its axis 13 to align the pins 11 with their respective pin sockets 21. When the cam follower 14 is in the slot 25, the pins 11 and sockets 21 are properly aligned. In addition, when the cam follower 14 is in the slot 25 the anti-drive lug 16 is aligned to engage the slot 26.

With the cam follower 14 in the slot 25 of the standpipe 23 and the pins 11 aligned with the sockets 21, a jackscrew 30 extending through the bore 12 engages the threaded socket 22 of the female coupler 20. The jackscrew 30 and the threaded socket 22 are used to draw the male coupler 10 into the female coupler 20 so that the pins 11 mate with their respective pins 21.

Whereas the present invention has been described with respect to a specific embodiment thereof, it is apparent that various changes and modifications will be suggested to one skilled in the art, and it is intended that the present invention encompass such changes and modifications as fall within the scope of the appended claims.

I claim:

1. An electrical connector assembly, comprising:

a female coupler having a longitudinal axis, a threaded socket on said axis, and a pin socket extending parallel to said axis;

an open-ended cylindrical standpipe attached to said female coupler and extending axially therefrom;

said open end of said standpipe having a rim forming a cam, said cam sloping to a slot in said standpipe that extends axially toward said female coupler;

a male coupler having a longitudinal bore along a coupler axis and a pin extending from said male coupler parallel to said male coupler axis;

a cam follower extending radially outward from said male coupler, said cam follower following said cam during connection of said couplers, thereby rotating said male coupler about said coupler axis so that said cam follower engages said slot to align and engage said pin with said pin socket, said cam follower comprising a lug and a cylindrical roller mounted on and rotatable about said lug; and a jackscrew extending through said bore for engaging said threaded socket to connect said couplers.

2. The electrical connector assembly of claim 1, wherein said male coupler comprises a plurality of pins and said female coupler comprises a corresponding plurality of pin sockets.

3. The electrical connector assembly of claim 1, further comprising:

an anti-drive lug extending radially outward from said male coupler, said anti-drive lug positioned opposite said cam follower at a predetermined distance in an axial direction away from said pins; and said standpipe having an anti-drive lug slot with a width less than a diameter of said cam follower and located in said standpipe opposite said cam follower slot.

4. A multiple pin electrical connector assembly, comprising:

a female coupler having a longitudinal axis, a threaded socket on said axis, and a plurality of pin sockets extending in said female coupler parallel to said axis;

an open-ended cylindrical standpipe attached to said female coupler and extending axially therefrom;

said open end of said standpipe having a rim forming a cam, said cam sloping to a slot in said standpipe that extends axially toward said female coupler;

a male coupler having a longitudinal bore along a coupler axis and a plurality of pins extending from said male coupler parallel to said male coupler axis;

a cam follower comprising a lug extending radially outward from said male coupler and a cylindrical roller mounted on and rotatable about said lug, said cam follower following said cam during connection of said couplers and causing rotation of said male coupler about said coupler axis so that said cam follower engages said slot to align and engage said plurality of pins with said corresponding plurality of pin sockets; and a jackscrew extending through said bore for engaging said threaded socket to connect said couplers.

5. The multiple pin electrical connector assembly of claim 4, further comprising:

an anti-drive lug extending radially outward from said male coupler on a side opposite said cam follower, said anti-drive lug displaced a predetermined distance from said cam follower in an axial direction away from said plurality of pins; and an anti-drive lug slot in said standpipe on a side opposite said cam follower slot.

6. The multiple pin electrical connector of claim 5, wherein said anti-drive lug has a diameter less than a diameter of said cam follower roller and said anti-drive lug slot has a width less than said diameter of said cam follower roller.

7. A self-aligning multiple pin electrical connector assembly, comprising:

a female coupler having a longitudinal axis, a threaded socket on said axis, and a plurality of pin sockets extending within said female coupler parallel to said axis;

an open-ended cylindrical standpipe attached to said female coupler and extending axially therefrom;

said open end of said standpipe having an antidrive lug slot and a cam follower slot opposite said anti-drive lug slot, wherein said standpipe has a rim forming a cam sloping from said anti-drive lug slot toward said female coupler and leading into said cam follower slot;

a male coupler having a longitudinal bore along a coupler axis and a plurality of pins extending from said male coupler parallel to said male coupler axis;

a cam follower comprising a lug extending radially outward from said male coupler and a cylindrical roller mounted on and rotatable about said lug, said cam follower following said cam during connection of said couplers, thereby rotating said male coupler about said coupler axis so that said cam follower engages said cam follower slot to align and engage said plurality of pins with said corresponding plurality of pin sockets;

an anti-drive lug extending radially outward from said male coupler opposite said cam follower, said anti-drive lug displaced a predetermined axial distance from said cam follower along said coupler axis away from said plurality of pins; and a jackscrew extending through said bore for engaging said threaded socket to connect said couplers.

8. The self-aligning multiple pin electrical connector assembly of claim 7, wherein a width of said anti-drive lug slot is less than a diameter of said cam follower roller.

* * * * *